United States Patent [19]

Lane et al.

[11] Patent Number: 5,037,281

[45] Date of Patent: Aug. 6, 1991

[54] TIP SEAL FOR SCROLL COMPRESSOR

[75] Inventors: William R. Lane, Dewitt; Howard H. Fraser, Jr., Lafayette, both of N.Y.

[73] Assignee: Carrier Corporation, Syracuse, N.Y.

[21] Appl. No.: 461,759

[22] Filed: Jan. 8, 1990

[51] Int. Cl.[5] ..... F04C 18/04; F04C 27/00; F16J 15/48

[52] U.S. Cl. ..... 418/55.4; 418/142; 277/204; 277/206 R; 277/235 R

[58] Field of Search ..... 418/55.4, 142; 277/27, 277/165, 204, 206 R, 235 R, 236

[56] References Cited

U.S. PATENT DOCUMENTS 3,603,603 9/1971 Woodson ..... 277/165

4,508,356 4/1985 Janian ..... 277/235 R 4,566,703 1/1986 Zitting ..... 277/165

*Primary Examiner*—John J. Vrablik

[57] ABSTRACT

A tip seal for scroll type compressors is provided to seal the tips of the scroll wraps of the stationary and orbiting scrolls. The seal consists of a "C" shaped cross sectional spring formed to fit in a slot in the tip of the scroll wraps. The spring is coated with a Teflon based material to seal the scroll tip from the high pressure side to the low pressure side and the center of the "C" shaped cross sectional spring is filled with an O-ring type neoprene material extending through at least part of the length of the spring to seal the core of the spring against leakage of fluid being compressed.

11 Claims, 1 Drawing Sheet

TIP SEAL FOR SCROLL COMPRESSOR

BACKGROUND OF THE INVENTION

This invention relates to rotating pumps or compressors of the scroll type and is more particularly directed to an improved construction involving an improved scroll tip seal.

Scroll type compressors have been known, in principle, for several decades. In general, a scroll-type compressor or similar machine comprises a pair of mating scrolls, each of which has an involute spiral wrap of similar shape, mounted on respective base plates. Normally, one scroll is held fixed, and the other is movable, to orbit but not rotate, about the axis of the fixed scroll, being held by an Oldham ring or other anti-rotating structure. The walls of the two involute wraps define crescent-shaped volumes which become smaller and smaller and move from the outside to the center of the mating scrolls as the orbiting scroll revolves. A compressible fluid, such as a refrigerant gas, can be introduced at the periphery of the spiral wraps, and is compressed as it is moved under the orbiting motion of the device. The compressed fluid is then discharged at the center. By introducing a compressed fluid at the center and permitting its expansion to drive the device, the scroll machine can be used as a motor.

The orbiting motion of the moving scroll means that at the tip of the scroll wrap of both the orbiting and the stationary scroll there is a convoluted interface across which the fluid being compressed can leak from the high pressure side to the low pressure side of these devices. To minimize leakage at the scroll tip the devices have been manufactured with extremely tight tolerances but it still has been found desirable to provide a tip seal to further reduce leakage. The standard type O-ring materials placed in a slot in the scroll wrap tips have been unsatisfactory for a number of reasons, principally swelling of the material and consequent loss of spring rate such that the sealing effectiveness of the material is lost or the material disintegrates and inhibits the orbiting action of the movable scroll.

A proposed solution to the tip seal problem in the past has been an elongated "C" shaped cross section spring placed in a groove in the tip of the scroll from one end to the other. The spring is made from a sheet of spring steel formed into a "C" shaped cross section and coiled to match the scroll. This solid continuous spring member has been usually covered with a sealing and anti-friction Teflon based material, to enhance the sealing action of the spring against the base of the opposite scroll and to minimize frictional losses under the heat generated by the fluid compressing action. It has been found that the "C" shaped cross section spring has provided good seal compliance and has not been subject to loss of spring rate. It has, however, offered a leakage path through the center of the "C" from the high side center of the scroll to the low side periphery of the scroll by leakage across the tip into the center of the spring. This has reduced the effectiveness of the "C" shaped elongated spring tip seal.

OBJECTS AND SUMMARY OF THE INVENTION

Accordingly it is an object of this invention to provide a scroll tip seal of improved design which avoids the drawbacks of the prior art.

It is another object of this invention to provide a scroll type compressor tip seal which eliminates leakage across the tip of the fixed and orbiting scroll wraps.

It is a still further object of this invention to provide a scroll compressor tip seal that provides an effective seal not only across the tip of the scroll wrap but also through the core of the tip seal disposed in the scroll wrap tip.

In accordance with an aspect of the present invention, a scroll type compressor is provided with a tip seal including an elongated tubular "C" shaped cross section spring disposed in a slot in a scroll wrap tip which has a spring cover on the outer surface thereof and a cylindrical O-ring of resilient material disposed throughout the interior of the "C" shaped cross section spring. This new composite seal is mounted in a slot in the scroll wrap tip throughout the length of the slot so as to seal against leakage not only across the tip of the scroll wrap but also lengthwise through the seal member.

The above and many other objects, features, and advantages of this invention will present themselves to those skilled in the art from a reading of the ensuing detailed description which is to be considered in connection with the accompanying Drawing.

DETAILED DESCRIPTION OF THE PREFERRED EMBODIMENT

Figure 1:
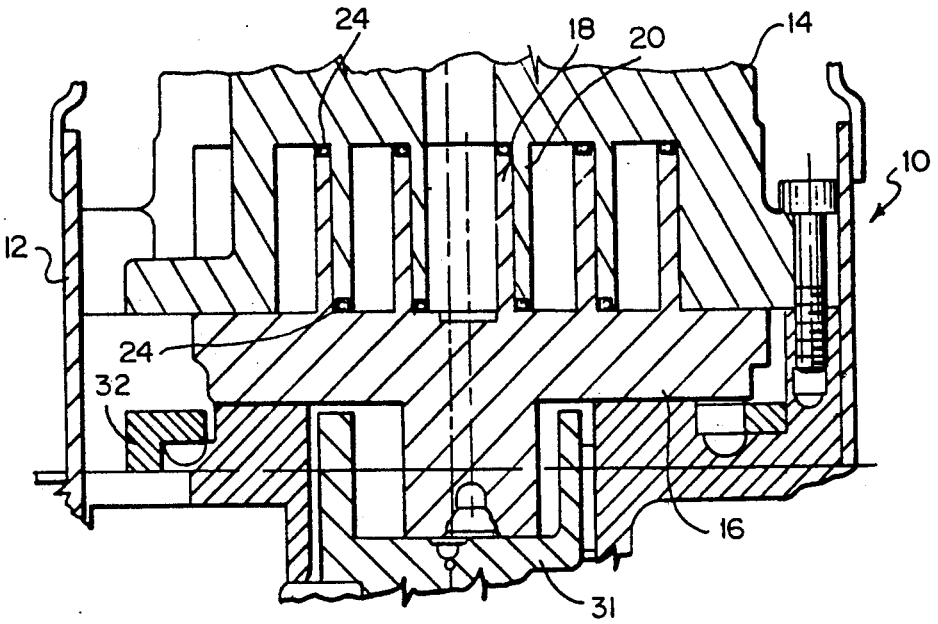
FIG. 1 is a cross sectional view of a scroll type compressor according to one preferred embodiment of the present invention.
Figure 2:
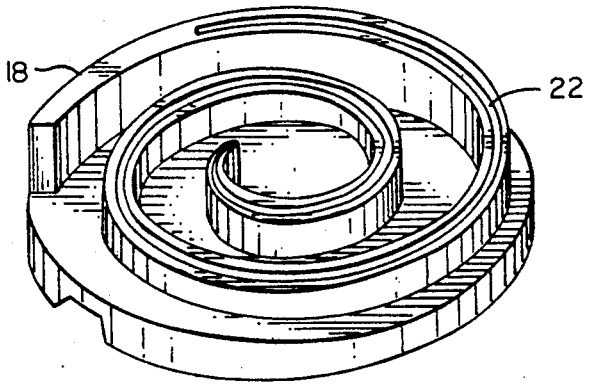
FIG. 2 is a perspective view of the movable scroll member of the compressor of FIG. 1 showing the groove in the tip of the scroll wrap.

Referring now to FIG. 1 there is shown a typical scroll type compressor 10 having a shell 12 in which is mounted a fixed scroll 14 and an orbiting or movable scroll 16. The movable scroll is driven by shaft 31 and prevented from rotating about its own axis by rotation-preventing means 32. As may be seen in FIGS. 1 and 2, the tips of the scroll wraps 18 and 20 of the fixed and movable scrolls have a slot 22 cut in the edge thereof through substantially the entire length of the scroll, to permit installation of a seal 24 in both the fixed and movable scroll tips. Seal 24 and slot 22 extend from the inner tip of the scroll outwardly to a point adjacent the outer end of the scroll. In some applications, this slot need not be extended to the full outer end because the pressure at the outer end is so low that very little, if any leakage occurs across the scroll at this point.

Figure 3:
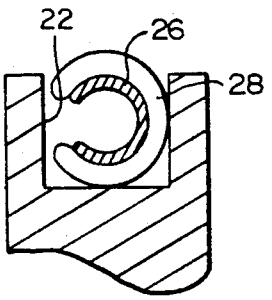
FIG. 3 Prior Art
FIG. 3 is a cross sectional view of a spring seal for the scroll wrap tip.

Referring now to FIG. 3, in the prior art, the seal 24 has generally consisted of a elongated spring member 26 disposed in the slot 22 throughout its entire length with the open side or opening of the "C" configuration facing the high pressure side of the scroll. The open side of the "C" is 90 degrees from the flat wall of the other scroll, with which the seal is to be formed. A seal is also formed between the seal 24 and the wall of the slot 22 on the low-pressure side of the scroll wrap, i.e., 180 degrees from the open side of the "C". The outside diameter of the spring is sufficient to provide a resilient sealing pressure against the base of the opposite scroll from the scroll tip in which the spring is mounted when installed in a slot and forced into closing contact with a flat surface. The spring 26 provides this sealing action initially until operating pressure is built up. Once operating pressure is developed pressure leakage into the center of the spring will push the seal apart to create the dominant sealing force at the scroll tip. The spring in the tip of the movable scroll interfaces with the base of the fixed scroll throughout its movement within the cooperating channel of the fixed scroll. In the prior art this spring member has been frequently coated with a spring covering 28 made of a Teflon based material, or other suitable low friction, resilient material that is resistant to the refrigerant or other fluid being compressed, and which provides the desired sealing action between the scroll tip and the cooperating scroll base.

With spring 26 covered with the covering 28 disposed in the tip of the scroll wraps 18 and 20 leakage across the tips of the respective fixed and movable scrolls was substantially reduced. It was soon discovered, however that leakage could occur through the interior or core of spring 26 from the high pressure inner tip to the outer lower pressure periphery s that the seal was not as effective in reducing leakage across the scroll wrap tips as was desired.

Figure 4:
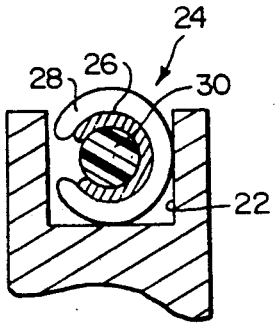
FIG. 4 is a cross sectional view through the tip of the scroll wrap showing the seal construction of the present invention.

Referring now to FIG. 4 it was discovered that by providing an "O" ring 30 type cylindrical member throughout the entire length of the spring 26 that this internal leakage of the seal could be substantially eliminated and the performance of the seal 24 at the scroll wrap tips greatly enhanced. The cylindrical "O" ring 30 is made from Freon resistant neoprene or other material resistant to attack by the fluid being compressed and forms a longitudinal seal within the spring 26. Cylindrical seal 30 is herein described as an "O" ring in accordance with industry practice even though it is not an annulus but is open ended.

Cylindrical "O" ring 30 is chosen with a diameter and resilience such that when it swells slightly due to contact with the refrigerant being compressed, it forms a tight seal all along the interior of spring 26 without causing undesired distortion of spring 26 which might cause excessive wear and ultimate failure of seal 24. The special neoprene mentioned above has been found to be satisfactory in this application and can be fully contained by spring 26.

While "O" ring 30 is shown in a preferred embodiment as extending throughout the entire length of spring 26 in some applications it may take the form of a shorter cylindrical seal in one segment only of the spring 26. With one of these internal seals, in the "C" shaped cross section tubular spring disposed in the tip of the scroll wrap, leakage from high pressure to low pressure sides of the scroll is virtually eliminated without destroying the long term effectiveness of the tip seal spring member. By making the O-ring 30 of suitable resilient material resistant to the fluid being compressed and confining it in the spring 26 the spring seal 24 continues to function in its original design fashion to seal the tip of the scroll wrap. The disadvantages of prior O-ring type seals is overcome by the spring member 26 itself, confining any swelling of the O-ring member 30 to the interior of the seal so as not to affect the sealing action of the outer surface of the covered spring seal while at the same time preventing disintegration of the O-ring 30 so as to interfere with the orbiting of the movable scroll.

While this invention has been described in detail with reference to a single preferred embodiment, it should be understood that the invention is not limited to that precise embodiment. Rather many modifications and variations will present themselves to those of skill in the art without departing from the scope and spirit of this invention as defined in the appended claims.

What is claimed is:

1. An "O" ring type seal for use in compressors and the like wherein it is desired to form a fluid seal between two interfacing surfaces comprising in combination:

an elongated cylindrical "O" ring formed of resilient material;

an elongated tubular spring member having a "C" shaped cross section disposed about said "O"-ring; and a semi-tubular sleeve of low friction, sealing material enclosing said spring member;

so that when said combination seal is disposed in a cooperative slot positioned in a first surface opposite a second surface with which to form a seal, said semi-tubular sleeve will form a resilient seal between said surfaces and said "O" ring will form a longitudinal seal within the interior of said elongated spring member.

2. A device as described in claim 1 wherein said combination seal is formed to fit in a slot in the scroll wrap tip of a scroll type compressor.

3. A device as described in claim 2 wherein said spring member has an opening in the "C" shaped cross-section thereof and said open portion of the "C" shaped cross section spring member is displaced 90° from the surface with which a seal is to be formed.

4. A device as described in claim 2 wherein said spring member has an opening in the "C" shaped cross-section thereof and said open portion of the "C" shaped cross section spring member is displaced 180° from the surface with which a seal is to be formed.

5. In a scroll compressor for compressing fluids of the type having a shell which contains a fixed scroll and an orbiting scroll which is disposed off the axis of the fixed scroll for revolving about the axis of the fixed scroll, rotation-preventing means for holding the orbiting scroll against rotation but permitting it to revolve in an orbiting motion, and means mounted within the shell for driving said orbiting scroll in its orbiting motion; tip seals disposed along respective tips of wraps of said fixed and orbiting scrolls comprising a slot formed in the fixed and movable scroll wrap tips, an elongated spring having a "C" shaped cross-section positioned in said slot in the scroll wrap tips, a sealing coating covering the outer surface of said elongated spring, and a cylindrical "O" ring member positioned in the core of at least a segment of said elongated spring to seal the center of said spring from migration of fluid being compressed through the core of said spring.

6. A scroll compressor for compressing fluids of the type including a shell which contains a fixed scroll and an orbiting scroll which is disposed off the axis of the fixed scroll for revolving about the axis of the fixed scroll, rotation-preventing means for holding the orbiting scroll against rotation but permitting it to revolve in an orbiting motion, drive means mounted within the shell for driving said orbiting scroll in its orbiting motion, and tip seals disposed along respective tips of wraps of said fixed and orbiting scrolls including a slot formed in each of the fixed and movable scroll wrap tips, an elongated spring having a "C" shaped cross-section mounted in said slot in the scroll wrap tips, a sealing coating covering the outer surface of said elongated spring, wherein the improvement comprises a cylindrical "O" ring member mounted within said spring and extending from end to end thereof, and said sealing coating and "O" ring being made of materials resistant to attack by heat, pressure, and the fluid being compressed.

7. A device as described in claim 1 wherein said sealing coating is made from a Teflon based material and said cylindrical "O"-ring is made from a neoprene based material.

8. A device as described in claim 6 wherein said sealing coating is made of a friction reducing, heat resistant material and said O-ring is made of a resilient sealing material that swells slightly in contact with the fluid being compressed to fill and completely seal the interior of said "C" shaped cross section spring.

9. A device as described in claim 6 wherein said "C" shaped cross section spring member has an opening in the surface thereof, and said spring is disposed in said slot with the opening of the "C" facing the high pressure side of the scroll wrap.

10. A device as described in claim 6 wherein said "O"-ring is made of a resilient material sized to just fill the interior of the "C" shaped cross section spring so as not to inhibit spring compliancy when said spring is compressed between the tip of one scroll and the base of the cooperating scroll while at the same time sealing the interior of the spring against the leakage of fluid being compressed.

11. A device as described in claim 10 wherein said O-ring is made from Freon resistant neoprene.

* * * * *